United States Patent [19]

Persson

[11] 4,307,872

[45] Dec. 29, 1981

[54] APPARATUS FOR REDUCING ORE

[75] Inventor: John A. Persson, Gibsonia, Pa.

[73] Assignee: Lectromelt Corporation, Pittsburgh, Pa.

[21] Appl. No.: 170,651

[22] Filed: Jul. 21, 1980

[51] Int. Cl.[3] ..... H05B 7/18

[52] U.S. Cl. ..... 266/171; 13/9 R; 13/35; 75/11

[58] Field of Search ..... 13/9 R, 35; 75/11; 266/171

[56] References Cited

U.S. PATENT DOCUMENTS 1,416,584 5/1922 Sicard ..... 13/35

2,769,706 11/1956 Herneryd et al. ..... 13/9 R X

*Primary Examiner*—M. J. Andrews

*Attorney, Agent, or Firm*—Fred Wiviott

[57] ABSTRACT

Ore taken from the group consisting of low-grade manganese ore ferromanganese ore and chromium ore is reduced in an electric arc furnace having two melting zones divided by a barrier. Ore and a small quantity of carbon are melted in the first zone and ore and a larger proportion of carbon are melted in the second zone. The molten metal product in the first zone forms a pool below a molten layer of slag having a high content of metal above which is disposed unmelted ore and carbon. The slag layer is flowed over the barrier to the second zone for enriching a second charge of ore and carbon therein. Depending upon the type of ore being reduced, a first molten product such as iron or high-grade ferromanganese is tapped from the first zone and a second molten product such as high-grade ferromanganese, high-grade ferrochromium or silicomanganese is tapped from the second zone. The barrier may be formed of carbon covered by a surface layer of titanium carbide.

5 Claims, 2 Drawing Figures

APPARATUS FOR REDUCING ORE

FIELD OF THE INVENTION

This invention relates generally to the art of smelting and more particularly to a method and apparatus for the reduction of ore within a single furnace.

BACKGROUND OF THE INVENTION

In the production of steel, various chemical elements are added to the molten ferrous metal to remove undesirable constituents, such as oxygen and sulphur, and to impart one or more desirable properties. These properties may include controlled grain size, improved mechanical strength, and corrosion resistance, among others. Such elements, called addition agents, may include various alloys of iron, termed ferroalloys. Two important addition agents are ferromanganese and ferrochromium which commonly used to remove and control sulphur and to introduce the elements manganese and chromium into molten steel. Typically ferromanganese has 78–84 percent manganese, a maximum of 7.5 percent carbon, and smaller percentages of other elements while ferrochromium has a similar proportion of chromium. Ferromanganese and ferrochromium are normally produced by refining or ferromanganese or ferrochromium ores having a manganese or chromium to iron ratio of about 7:1.

In one method of producing silicomanganese, standard grade, high carbon ferromanganese is produced from high-grade ore leaving up to 50% manganous oxide in the gangue-containing slag. After cooling and crushing, this slag is resmelted in a charge containing a lower grade of manganese, silica (which may be a constituent of the ore, reductant in the form of carbon, such as cool or coke, and possibly additional fluxes.

Various types of furnaces, such as electric arc furnaces, are employed in smelting processes. One prior art method of producing ferromanganese by reduction employed pairs of electric arc furnaces. The first furnace was charged with manganese-bearing ore along with other materials such as carbon which are required in the smelting process. Certain of the intermediate products obtained thereby are transported to a second furnace for further reduction which results in ferromanganese or silicomanganese along with other products.

Since the temperatures required for the reduction of ferromanganese and ferrochromium ores are relatively high, usually above 1400° C., and since the heat transfer rate between bodies of disparate temperature is directly related to the temperature differences between the two bodies, it is advantageous from an energy conservation standpoint to retain any material being transported from a first stage to a second stage in a high temperature ambient. In smelting processes using separate furnaces, the material was cooled and crushed prior to delivery to the second furnace. As a result, considerable heat was lost, requiring the addition of this lost energy in the second furnace. Prior art smelting processes employing two furnaces also have substantial manpower requirements. Because of energy, equipment and manpower costs, prior art processes are not normally employed for smelting low-grade ferromanganese or ferrochromium ores which have a manganese or chromium to iron ratio of about 4.5:1.

Another disadvantage of prior art furnaces is that the carbon refractory brick used to line the vessel hearths was often absorbed into the product resulting in unpredictable variations in product chemistry as well as erosion of the refractory material itself.

OBJECTS OF THE INVENTION

It is a primary object of the present invention to provide a new and improved smelting method and apparatus for the reduction of ores taken from the group consisting of manganese ore and chromium ore.

Another object of the present invention is to provide a smelting method for reducing low-grade manganese and chromium ores.

Yet another object of the present invention is to provide a furnace wherein stages of manganese or chromium ores reduction process may be performed simultaneously.

Still another object of the invention is to provide a method of producing ferromanganese and silicomanganese in a single vessel.

A further object of the present invention is to provide a method and apparatus permitting tapping of intermediate and final products.

Yet a further object of the present invention is to provide a two-stage smelting furnace wherein charge quantity and composition may be separately controlled in each stage.

A still further object of the present invention is to provide a two-stage smelting furnace wherein the profile and integrity of the furnace hearth lining may be retained.

Yet a further object of the present invention is to provide a lining for a ferromanganese melting furnace that does not contaminate the melt.

How these and other objects of the invention are accomplished will be described in the following specification taken in conjunction with the drawing. Generally, however, the objects are accomplished by utilizing a two zone electric arc furnace. The furnace has a contoured floor for dividing the bath into a distinct quantity in each zone while permitting free flow of slag therebetween. A titania-bearing compound may be applied to the carbon refractory so that when the furnace is heated to an elevated temperature, a titanium carbide layer is formed which is essentially impervious to the otherwise destructive effects of the reduction process.

In accordance with another aspect of the present invention, a carbon-deficient charge of low-grade ferromanganese or ferrochromium ore and carbon is reduced in the first furnace zone and a carbon rich charge of low-grade ferromanganese or ferrochromium ore and carbon is refined in a second zone. The molten charge in the first zone separates into a pool of molten iron which is recovered and a ferromanganese or ferrochromium rich slag layer which flows to the second zone for enriching the molten ore therein.

In accordance with a further aspect of the invention a charge of manganese ore and a reductant such as carbon are melted in a first zone to produce ferromanganese and a manganese oxide rich slag which is flowed to a second furnace zone for enriching a charge of silicomanganese and a reductant for producing silicomanganese.

Other features of the present invention which aid in satisfying the above-noted objects will be described in the following detailed description of the preferred embodiment.

DESCRIPTION OF THE PREFERRED EMBODIMENT

Figure 1:
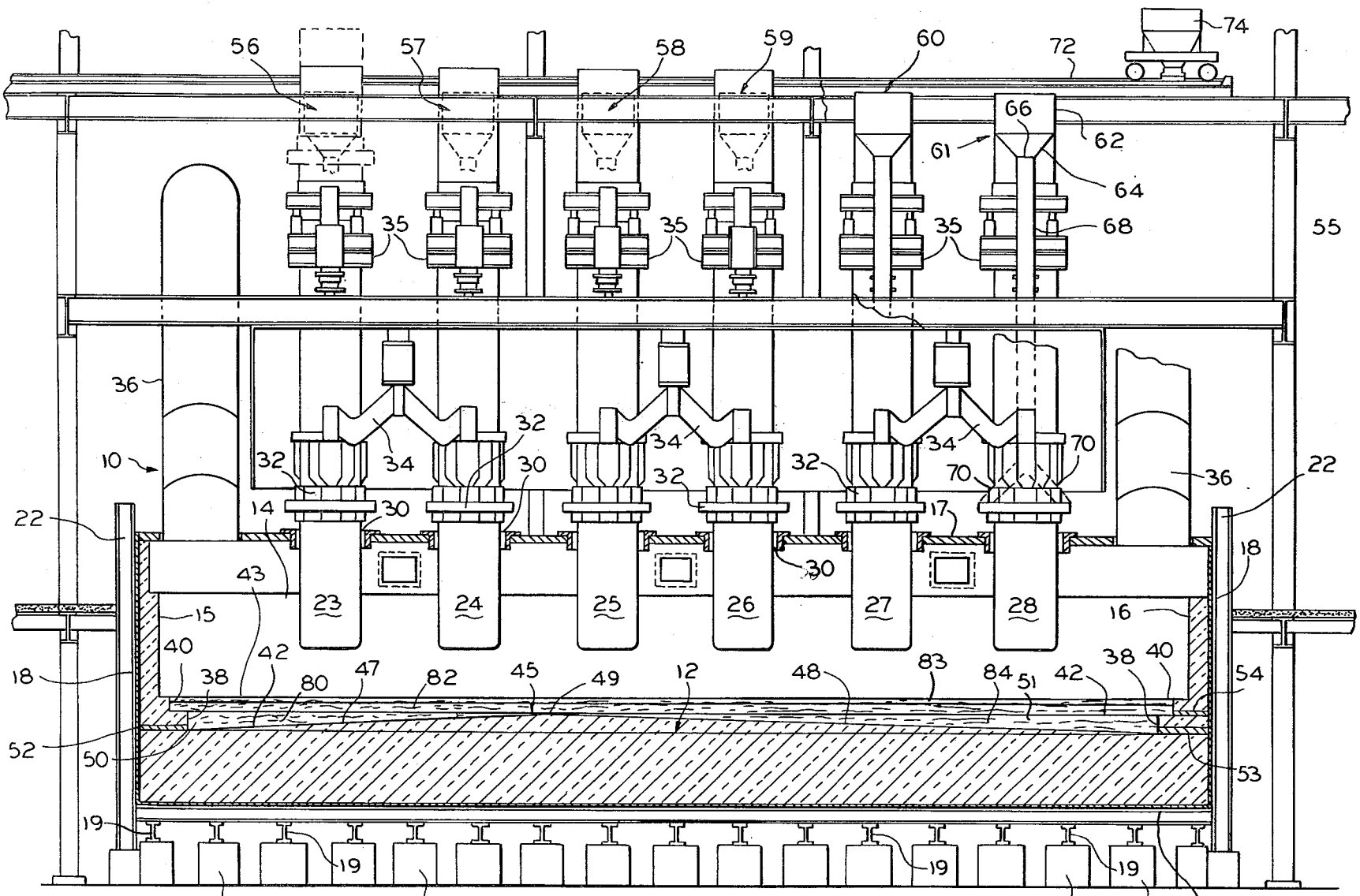
FIG. 1 is a side elevation view of a direct reduction electric arc furnace employed in carrying out the process of the present invention with a portion broken away.
Figure 2:
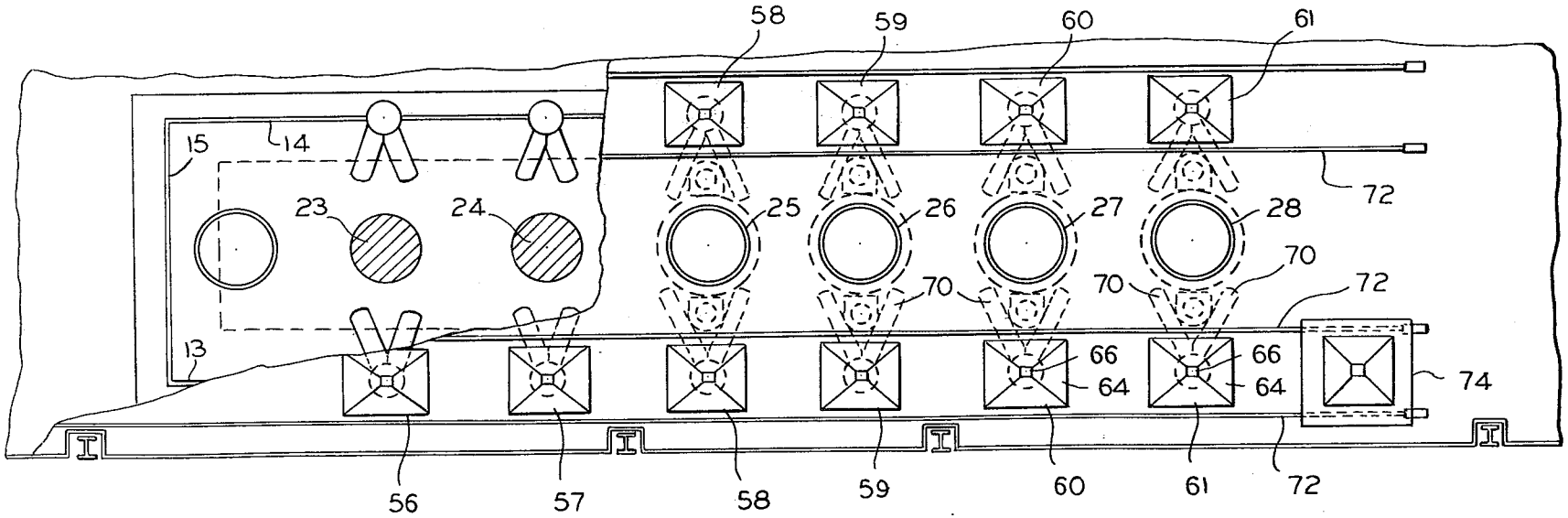
FIG. 2 is a top plan view of the furnace of FIG. 1 with parts broken away.

FIG. 1 shows an electric arc furnace 10 in which the method according to the invention may be carried out. The furnace 10 may be generally rectangular in plan view and includes a refractory hearth 12, generally vertical refractory walls which include a front wall 13, a rear wall 14, side walls 15 and 16, and a refractory roof 17. A metallic shell 18 may be disposed beneath hearth 12 and around side walls 13, 14, 15 and 16. In addition, the hearth may be mounted on a suitable support consisting of longitudinally and transversely extending I-beams 19 disposed on footings 20. Lateral support for the side walls 13–16 is provided by vertically extending I-beam members 22.

A plurality of electrodes 23, 24, 25, 26, 27, and 28 extend vertically through spaced-apart openings 30 in roof 17 and while self-baked carbon electrodes are illustrated, it will be understood that pre-baked carbon electrodes may also be employed. Electrical energy is supplied to each of the electrodes by a suitable arrangement of contact plates 32 which engages its respective electrode above the furnace roof. The contact plates associated with each pair of electrodes are connected by suitable conductors 34 to a source of electrical energy such as a single phase alternating current transformer (not shown). Conventional electrode slipping mechanisms 35 engage each of the electrodes 23–28 for supporting and feeding the same into the furnace 10 as the lower ends are consumed. For a more complete description of such a slipping mechanism, reference is made to U.S. Pat. No. 4,154,974. Exhaust stacks 36 may connect the furnace 10 to a suitable gas cleaning system, not shown, for withdrawing and treating gaseous combustion products of the smelting operation.

The intersections of the hearth 12 and walls 14, 15, 16 and 17 are defined by step-like formations consisting of vertical risers 38 and 40 and horizontal surfaces 42 and 43. A refractory separator 45 is also formed in the hearth and is defined by a first planer upper surface 47 which slopes inwardly and upwardly from the base of riser 38 at the foot of wall 15 to the level of the surface 42 at a point below the gap between electrodes 24 and 25. Separater 45 is also defined by a second planer surface 48 which slopes inwardly and upwardly from the base of riser 38 at the foot of wall 16 to the intersection of surfaces 42 and 47. This defines a divider 49 in hearth 12 and first and second basins 50 and 51 on the opposite sides thereof. Because of the greater power requirement in the second basin, the divider 49 is preferably located such that the ratio of electrodes above the first basin 50 to those above the second basin 51 is 1:2.

A first tap hole 52 extends through the end wall 15 to communicate with the first basin 50 at about the intersection of the riser 38 and surface 47 and second and third tap holes 53 and 54 with basin 51 at about the intersection of riser 38 and surface 48 and at the riser 40. Those skilled in the art will appreciate that a removable plug of refractory material is disposed in each tap hole during operation and that a spout (not shown) is provided at the outlet end of each for directing molten material into a suitable ladle or the like.

A framework 55 is disposed adjacent the furnace 10 and extends upwardly along the sides thereof for supporting the slipping mechanisms 35 and a plurality of hoppers 56, 57, 58, 59, 60 and 61 above the furnace roof 22 and on the opposite sides of respective electrodes 23, 24, 25, 26, 27 and 28. Each hopper includes a storage bin 62 having a lower end 64 which is generally funnel shaped and has a central opening 66. A vertical extending discharge conduit 68 is coupled at its upper end to the central opening 66 and its lower end to a pair of feed pipes 70 which extend into roof ports adjacent to and on opposite sides of its respective electrode.

The framework 55 also supports two pairs of rails 72, one pair of which is disposed above each row of hoppers 56–61. One or more hopper cars 74 may be disposed on each pair of rails for being selectively positioned above the respective hoppers and for discharging the required furnace charge into each. It can be seen that hoppers 56 and 57 are positioned to feed charge into basin 50 while hoppers 58, 59, 60 and 61 are positioned to feed charge into the basin 51. A valve or gate will be disposed in each of the hopper openings 66 so that the charge material can be fed into the furnace selectively.

In performing the method according to a first aspect of the invention, a charge of low-grade manganese ore; i.e., having a manganese-to-iron ratio of about 4 or 5 to 1, is charged into the hoppers 56 and 57 along with a small proportion of carbon in the form of coke. The charge comprises about 90% to 99% ore and about 10% to 1% carbon in the form of coke. In addition, a carbon rich charge; i.e., about 70% to 85% manganese ore of the same grade and about 30% to 15% carbon in the form of coke is charged into the hoppers 58–61. Flux in the form of lime or silica for chemical balancing may also be charged into each of the hoppers 58–61, depending upon the chemistry of the ore being charged.

The furnace 10 may be operated in either a batch or continuous mode, but, in either case, the contents of the hoppers 56 and 57 will be charged into basin 50 while the charge of hoppers 58–61 will be fed into basin 51. The electrodes 23–28 will be energized to provide the required heat of fusion. As the ore is smelted, pig iron 80 will separate from the molten ore 82 and form a molten pool. The layer of molten ore 82 will be covered by a slag layer 83. The rate of metal discharge through tap hole 52 is maintained such that the molten pig iron 80 will substantially fill the basin 50 but will not overflow into the basin 51. The molten ore 82 and the slag layer 83 floating on top of the molten pig iron will, however, flow freely across the divider 49 and into the basin 51. Simultaneously, a molten pool of ferromanganese 84 will form in the basin 51. The rate of metal discharge from tap hole 53 will also be controlled to maintain the pool of ferromanganese such that it does not overflow the divider 49. In a continuous process, the molten pig iron will be withdrawn through tap hole 52 and the molten ferromanganese from tap hole 53 at a rate to permit substantially continuous or intermittent feeding of the charge materials. In addition, excess slag may be tapped periodically from tap hole 54.

Table 1 shows a typical low-grade manganese ore as mined and after calcining.

TABLE 1

| | As Mined % | After Calcining % |
|---|---|---|
| Mn | 27 | 39.7 |
| Fe | 6 | 8.8 |
| $SiO_2$ | 10 | 14.7 |
| $Al_2O_3$ | 2.5 | 3.7 |
| CaO | 6 | 8.8 |
| MgO | 7 | 10.3 |
| S | 0.5 | .2 |

A typical carbon poor charge in hoppers 56 and 57 would comprise 159 kg of calcined ore and 25 kg of coke (76% C.). Upon fusion, this would produce 85 kg of pig iron with an attendent expenditure of energy of approximately 60 kwh in electrodes 23 and 24. In addition, 1060 kg of calcined ore and 325 kg of coke (76% C.) would be charged into the basin 51 from hoppers 58–61.

As indicated above, the fusion of the carbon poor charge in the basin 51 will cause a separation of pig iron from the molten ore 82 and in addition the formation of a slag layer 83. These materials will layer in accordance with their specific gravity causing the molten pig iron 80 to collect in the basin 51 with the molten ore 82 disposed thereabove and covered by the slag layer 83. The rate of metal removal from tap hole 52 and the furnace dimensions will be such that a pool of pig iron 80 will substantially fill the basin 51 but not overflow the divider 49 while the molten ore 82 and slag 83 may flow over the peak 49 and toward the basin 51.

The initial charge of manganese ore will contain about 39.7% manganese and about 8.8% iron by weight or in the 1590 kg ore charge, about 630 kg of manganese and about 140 kg of iron or a manganese-to-iron ratio of 4.5:1. The withdrawal of about 85 kg of iron from the molten ore from basin 50 will leave about 55 kg of iron in the layer of molten ore 82 and slag 83. The charge of about 1060 kg of the same ore from hoppers 58–61 will provide about 92 kg of iron and about 420 kg of manganese. The addition of the manganese rich melt in the layer 82 and the manganese dissolved in the slag 83 will provide about 1050 kg of manganese available to the basin 51 and about 147 kg of iron. This will provide a manganese-to-iron ratio of about 7.8:1 which is equivalent to that of a high-grade ore. The yield of the furnace in the above example will be about 1000 kg of ferromanganese, consisting of 78–80% manganese, with the expenditure of about an additional 2200 kwh at electrodes 25, 26, 27 and 28.

The slag which is tapped from the furnace through tap hole 54 would have the following partial compositions:

| | |
|---|---|
| Fe | 0.7% |
| Mn | 15 |
| CaO | 19 |
| MgO | 18 |
| $S_1O_2$ | 31 |

However, the actual slag composition could vary over a wide range depending upon the grade of ore used. The manganese content of the slag in particular could vary from about 3% to 40%.

As those skilled in the art will appreciate, the lining of smelting furnaces may comprise carbon blocks. In order to prevent the absorption of carbon by the iron or ferromanganese, the lining is stabilized by the addition of titania in the charge upon initial start-up of the furnace 10. This may take the form of ilmenite or titania bearing ore. As the furnace is initially brought up to temperature, stable titania carbides are formed on the lining surface to provide a substantially impervious interface with the metal to be contained. In this manner the lining can be retained in its original shape through a substantial number of operating cycles.

The furnace and method hereinabove described provide an acceptable grade of ferromanganese from a low-grade manganese ore without inordinate costs or power consumption.

When the furnace 10 is employed in the manufacture of ferrochromium, the charge delivered to basin 50 includes low-grade chromium ore, i.e., having a chromium to iron ratio of about 1:5 and a combined chromiun-iron content of about 44.8% and a small proportion of reductant which may comprise coke, cool, lignite, or charcoal. Preferably, the charge will contain about 51% chromium and about 13.5% reductant with the two constituting at least 39% of the total furnace charge. However, the proportion of chromium bearing charge can be increased for power balancing purposes. The basin 51 is charged with a carbon rich charge of ore and carbon, e.g. not more than 49.2% of the total chromium charge and about 86.5% of the total reductant carbon. Flux in the form of limestone, lime and silica for chemical balance may also be charged into basin 51.

As in the production of ferromanganese, iron separates from the molten ore and slag and collects in basin 50. The chromium rich slag is free to float over the barrier 49 into the basin 51 for enriching the charge therein. In this process, about 20% of the metal output is in the form of iron tapped from basin 50 and about 80% in the form of a ferroalloy containing about 70% chromium which is tapped from basin 51.

In the production of silicomanganese, a high-grade manganese ore, i.e. having a manganese-to-iron ratio of about 7:1 is charged into basin 50. Basin 51 is charged with a lower grade ferromanganese ore, i.e. having a manganese-to-iron ratio of about 5:1, silica, which can be a constituent of the ore or quartz, a reductant such as carbon in the form of coal or coke and possibly additional fluxes, such as lime. As the ore melts in basin 50 standard grade ferromanganese is formed along with a covering slag layer containing about 50% manganese oxide. The slag is free to flow over barrier 49 into basin 51 while the iron may be removed through tap hole 52. The manganese oxide in the slag and the admixed manganese ore are reduced by the carbon to produce silicomanganese which may be withdrawn through tap hole 53. The proportions of ore, slag and quartz in basin 51 may vary over a relatively wide range.

While only a few embodiments of the invention have been illustrated and described, it is not intended to be limited thereby, but only the scope of the appended claims.

I claim:

1. An arc furnace including a furnace body having a pair of opposed side walls and first and second opposed end walls, a plurality of electrodes extending into said furnace body, means defining a hearth within said furnace body and adjacent its lower end, a divider formed on said hearth and extending upwardly from the lower end of said furnace body, said divider comprising a first inclined generally planar surface extending upwardly from the first end wall and toward the second end wall and a second inclined generally planar surface extending upwardly from said second end wall and toward said first end wall, said first and second surfaces converging to define a peaked portion in said hearth, said surfaces and said side and end walls defining first and second basins on the opposite sides of said peaked portion, a first group of said electrodes being disposed above said first basin and a second group of said electrodes disposed above said second basin, material feeding means for separately feeding a furnace charge into each of said basins, means formed in said furnace body for separately tapping molten material from each of said basins, whereby low-grade molten ore may be melted on one side of said divider to form a pool of molten product therein and molten metal rich slag disposed thereabove for floating over said divider to enrich a quantity of molten ore on the other side of said divider.

2. The furnace set forth in claim 1 wherein said furnace body is generally elongate, said electrodes being arranged in a row and generally spaced apart one from the other, said peaked portion being formed below the gap between two of the electrodes in said row.

3. The furnace set forth in claim 2 wherein the ratio of electrodes in said first group to those in second group is 1:2.

4. The furnace set forth in claims 1, 2 or 3 wherein said hearth is formed of carbon and has a titania carbide surface exposed to the interior of said furnace.

5. The furnace set forth in claim 4 wherein said furnace is generally rectangular in plan view, said planar surfaces being generally normal to said side walls and intersecting along a line generally normal to said side walls to define said peaked portion.

* * * * *